US009466412B2

(12) United States Patent
Cho et al.

(10) Patent No.: US 9,466,412 B2
(45) Date of Patent: Oct. 11, 2016

(54) MAGNETIC CONTACTOR

(71) Applicant: Hyundai Heavy Industries Co., Ltd., Ulsan (KR)

(72) Inventors: Dong Jin Cho, Seoul (KR); Dong Kyu Shin, Seoul (KR); Young Myoung Yeon, Chungcheongbuk-Do (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 0 days.

(21) Appl. No.: 14/750,831

(22) Filed: Jun. 25, 2015

(65) Prior Publication Data

US 2015/0380142 A1 Dec. 31, 2015

(30) Foreign Application Priority Data

Jun. 30, 2014 (KR) ..... 10-2014-0081075

(51) Int. Cl.

*H01H 9/00* (2006.01)
*H01F 7/08* (2006.01)
*H01F 7/02* (2006.01)
(Continued)

(52) U.S. Cl.

CPC ..... *H01F 7/081* (2013.01); *H01F 7/0231* (2013.01); *H01H 50/36* (2013.01); *H01H 51/2209* (2013.01); *H01F 7/1615* (2013.01); *H01F 2007/083* (2013.01); *H01H 50/20* (2013.01); *H01H 50/546* (2013.01); *H01H 51/065* (2013.01)

(58) Field of Classification Search

CPC ..... H01F 7/081; H01F 7/0231; H01F 2007/083; H01H 67/02; H01H 7/1615; H01H 7/1623

USPC ..... 335/179

See application file for complete search history.

(56) References Cited

U.S. PATENT DOCUMENTS 4,541,563 A * 9/1985 Uetsuhara ..... A01G 25/16 137/624.2
4,644,311 A * 2/1987 Guery ..... H01H 51/2209 335/230

(Continued)

FOREIGN PATENT DOCUMENTS

CN 2745209 12/2005
DE 10012143 A1 10/2000

(Continued)

OTHER PUBLICATIONS

European Search Report dated Oct. 20, 2015 for Application No. EP 15 17 4716 (7 Pages).

*Primary Examiner* — Ramon M Barrera
*Assistant Examiner* — Lisa Homza
(74) *Attorney, Agent, or Firm* — Mintz Levin Cohn Ferris Glovsky and Popeo, P.C.; Peter F. Corless

(57) ABSTRACT

The magnetic contactor, according to an exemplary embodiment, includes: a moving core including a main core disposed to be movable in a length direction thereof and first and second core plates disposed at both ends of the main core, respectively; a coil provided on the circumference of the main core; a fixed core disposed around the coil to form a magnetic path; and a permanent magnet disposed between the coil and the fixed core, wherein the first core plate is disposed outside the fixed core, the second core plate is disposed inside the fixed core, and the fixed core is provided with at least one protrusion to reduce a gap between the fixed core and the first or second core plate.

7 Claims, 5 Drawing Sheets

(51) Int. Cl.

| | |
|---|---|
| ***H01H 50/36*** | (2006.01) |
| ***H01H 51/22*** | (2006.01) |
| *H01F 7/16* | (2006.01) |
| *H01H 50/20* | (2006.01) |
| *H01H 50/54* | (2006.01) |
| *H01H 51/06* | (2006.01) |

(56) References Cited

U.S. PATENT DOCUMENTS

| | | | | |
|---|---|---|---|---|
| 4,994,776 | A * | 2/1991 | Juncu | H01F 7/1646 335/230 |
| 6,556,114 | B1 * | 4/2003 | Guillemin | H01F 7/081 335/229 |
| 6,598,621 | B1 * | 7/2003 | Wygnanski | F16K 31/003 137/624.18 |
| 7,456,482 | B2 * | 11/2008 | Busta | H01H 1/0094 200/181 |
| 7,483,254 | B1 * | 1/2009 | Wang | H01H 33/6662 251/65 |
| 8,242,866 | B2 * | 8/2012 | Eum | H01H 50/56 335/127 |
| 2002/0057153 | A1 * | 5/2002 | Matsusaka | H01F 7/1607 335/220 |
| 2005/0104456 | A1 * | 5/2005 | Yajima | H02K 41/03 310/14 |
| 2007/0236089 | A1 | 10/2007 | Okubo | |
| 2010/0182112 | A1 | 7/2010 | Nagasaki | |
| 2012/0293287 | A1 * | 11/2012 | Lauraire | H01H 3/28 335/229 |
| 2016/0172137 | A1 * | 6/2016 | Liang | H01H 50/16 335/179 |

FOREIGN PATENT DOCUMENTS

| | | | |
|---|---|---|---|
| DE | 102011003169 | A1 | 7/2012 |
| JP | 2011-216785 | | 10/2011 |
| JP | 2012054177 | A | 3/2012 |
| KR | 10-1288627 | | 2/2012 |

* cited by examiner

MAGNETIC CONTACTOR

CROSS-REFERENCE TO RELATED APPLICATION

This application claims the priority and benefit of Korean Patent Application No. 10-2014-0081075 filed on Jun. 30, 2014, with the Korean Intellectual Property Office, the disclosure of which is incorporated herein by reference.

BACKGROUND

The present inventive concept relates to a magnetic contactor and, more specifically, to a magnetic contactor with improved driving force at the time that contacts are closed.

In general, a magnetic contactor includes: a case having an accommodating space in the interior thereof; a contact unit provided in the interior of the case and opening and closing the contactor connected to a main power source and a load; and a driving unit driving the contact unit.

The contact unit includes a fixed contact connected to the main power source or the load and a moving contact disposed to be in contact with, or be separable from, the fixed contact. The driving unit includes a fixed core fixed to the interior of the case and a moving core connected to the moving contact to move the moving contact.

A magnetic contactor, according to the related art, has relatively high magnetic resistance due to a wide gap between the moving core and the fixed core, and accordingly, it may be difficult for a magnetic flux to pass across the gap. For this reason, at the time of initially closing the magnetic contactor, electromagnetic force may be low and operating time may be extended.

SUMMARY

An aspect of the present inventive concept may provide a magnetic contactor with improved driving force at the time that contacts are closed, thereby minimizing the operating time thereof.

According to an aspect of the present inventive concept, a magnetic contactor may include: a moving core including a main core disposed to be movable in a length direction thereof and first and second core plates disposed at both ends of the main core, respectively; a coil provided on the circumference of the main core; a fixed core disposed around the coil to form a magnetic path; and a permanent magnet disposed between the coil and the fixed core, wherein the first core plate may be disposed outside the fixed core, the second core plate may be disposed inside the fixed core, and the fixed core may be provided with at least one protrusion to reduce a gap between the fixed core and the first or second core plate.

The protrusion may be disposed outside the first core plate when the first core plate moves close to the fixed core.

The protrusion may be disposed outside the second core plate when the second core plate moves close to a bottom surface of the fixed core in the interior of the fixed core.

The fixed core may include an upper plate and a lower plate disposed to face lower surfaces of the first core plate and the second core plate, respectively.

The upper plate and the lower plate may have inclined upper surfaces.

The inclined surfaces may be gradually lowered toward the main core.

The lower surfaces of the first core plate and the second core plate may be inclined to be parallel to the inclined surfaces of the upper plate and the lower plate.

BRIEF DESCRIPTION OF DRAWINGS

The above and other aspects, features, and advantages of the present inventive concept will be more clearly understood from the following detailed description taken in conjunction with the accompanying drawings, in which.

DETAILED DESCRIPTION

Figure 1:
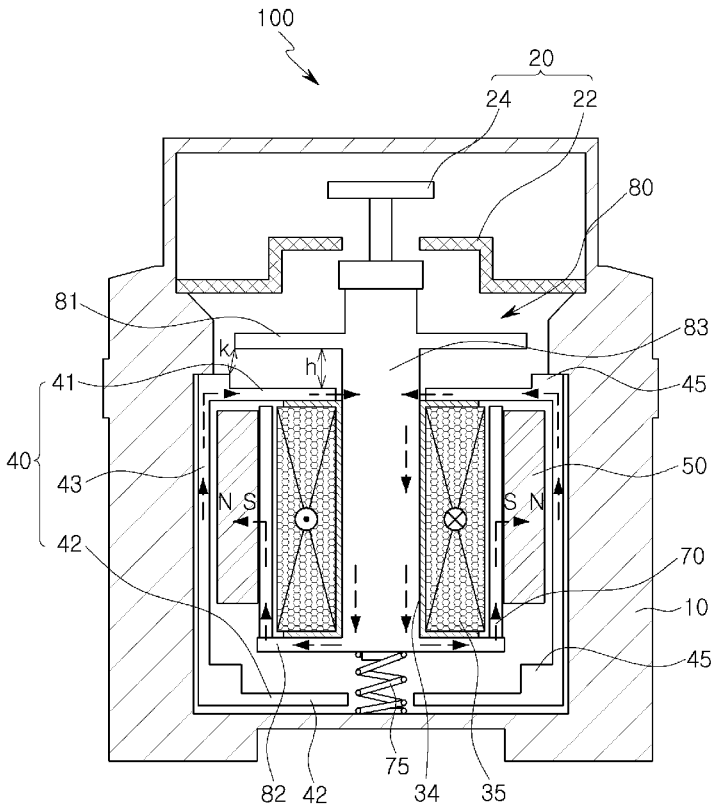
FIGS. 1 through 3 are schematic cross-sectional views of a magnetic contactor according to an exemplary embodiment of the present inventive concept.

Exemplary embodiments of the present inventive concept will now be described in detail with reference to the accompanying drawings.

The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements.

Figure 2:
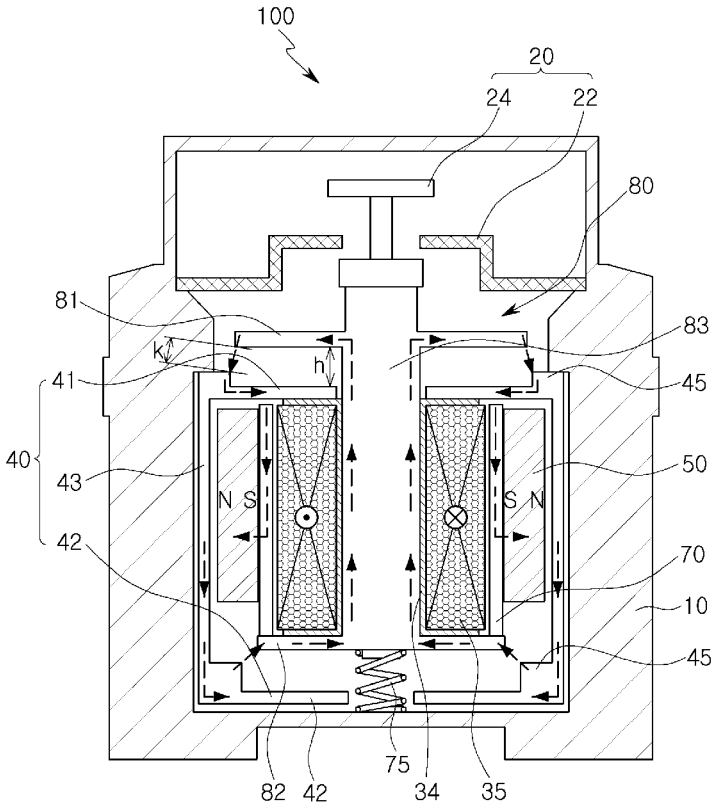
Figure 3:
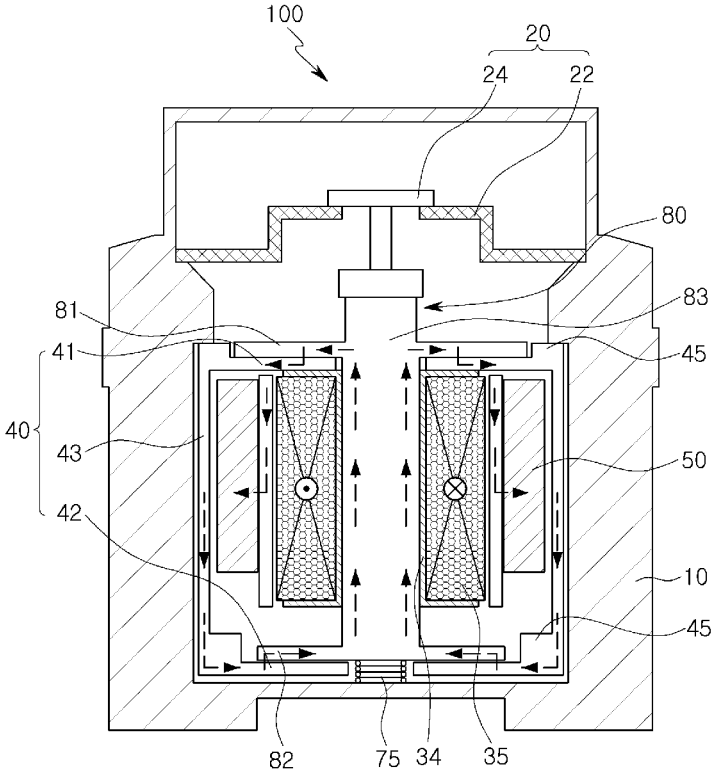

FIGS. 1 through 3 are schematic cross-sectional views of a magnetic contactor according to an exemplary embodiment of the present inventive concept. FIG. 1 illustrates a state of the magnetic contactor at the time that power is not applied to a coil. FIG. 2 illustrates a state of the magnetic contactor at the time of application of power to a coil. FIG. 3 illustrates a state of the magnetic contactor in which a moving core is moved after power is applied to a coil.

As illustrated in FIG. 1, a magnetic contactor 100 according to an exemplary embodiment of the present inventive concept may include a fixed core 40, a permanent magnet 50, a coil 35, and a moving core 80 disposed in the interior of a case 10.

The fixed core 40 may be fixed to the interior of the case 10, and the moving core 80 may be disposed in the interior of the fixed core 40. The fixed core 40 and the moving core 80 may be formed of a magnetic material. Accordingly, when power is applied to the coil 35, the cores may be used as a magnetic path of a magnetic field generated by the coil 35.

The fixed core 40 may provide a space in which the moving core 80, the permanent magnet 50, and the like are accommodated.

The fixed core 40 may include an upper plate 41, a lower plate 42, and a connection member 43 connecting the upper plate 41 to the lower plate 42.

The upper plate 41 and the lower plate 42 may be disposed to be parallel to each other in a horizontal direction, and the connection member 43 may be formed to connect an outer end of the upper plate 41 to an outer end of the lower plate 42.

In addition, the fixed core 40 may be formed to have a quadrangular ring or loop shape.

Furthermore, the connection member 43 of the fixed core 40 may be formed to have a vertical length long enough to accommodate the bottom of the moving core 80 therein.

The permanent magnet 50 may interact with magnetic force generated by the coil 35 when power is applied to the coil 35, thereby moving the moving core 80.

The permanent magnet 50 may be formed to have a rectangular plate shape, but is not limited thereto. In addition, a plurality of permanent magnets 50 may be provided.

The permanent magnets 50 may be disposed to face each other inside the fixed core 40. Here, the position of the permanent magnet 50 may correspond to the position of the coil 35, or a length direction of the permanent magnet 50 may correspond to a direction of movement of the moving core 80.

In addition, the permanent magnet 50 may be magnetized in a thickness direction thereof. For example, one surface of the permanent magnet 50 facing the inner surface of the fixed core 40 may be magnetized by a north pole (N), and the other surface thereof may be magnetized by a south pole (S).

Meanwhile, one side of the permanent magnet 50 may be provided with a permanent magnet plate 70. Therefore, the outer surface of the permanent magnet 50 may be in contact with the fixed core 40, while the inner surface thereof may be in contact with one surface of the permanent magnet plate 70.

The permanent magnet plate 70 may be formed of a magnetic material. For example, the permanent magnet plate 70 may be formed to have a rectangular plate shape. The permanent magnet plate 70 may be longer (or larger) than the permanent magnet 50.

In addition, the coil 35 and the bobbin 34 may be coupled to the other surface of the permanent magnet plate 70.

The coil 35 may be wound on the bobbin 34 to be coupled to the inner surface of the permanent magnet plate 70. A central hole may be formed in the bobbin 34, and the moving core 80 may be inserted into the hole of the bobbin 34 and be movable inside the hole.

The moving core 80 may include a bar-type main core 83 disposed to be movable in a length direction thereof, and core plates 81 and 82 extending from both ends of the main core 83 in an outer radial direction thereof.

The moving core 80 may be formed of a magnetic material so that the moving core 80 forms a magnetic path. The moving core 80 may be disposed to be movable in the length direction of the main core 83 inside the fixed core 40.

The main core 83 may have a circular cross-sectional shape, but is not limited thereto.

The core plates 81 and 82 may be formed to have a rectangular plate shape, and may be divided into a first core plate 81 disposed on the upper portion of the main core 83 and a second core plate 82 disposed on the lower portion of the main core 83.

The first core plate 81 may be disposed outside the fixed core 40. Therefore, when the moving core 80 moves downwardly, the first core plate 81 may contact an upper surface of the upper plate 41 of the fixed core 40 so that the downward movement of the moving core 80 is restricted.

In addition, the second core plate 82 may be disposed inside the fixed core 40, and may be disposed below the permanent magnet plate 70. Therefore, the moving core 80 may contact the bottom of the permanent magnet plate 70 so that the upward movement of the moving core 80 is restricted.

A contact unit 20 may be disposed above the moving core 80.

The contact unit 20 may include a fixed contact 22 and a moving contact 24.

The contact unit 20 may include the fixed contact 22 fixed to the interior of the case 10 and the moving contact 24 disposed to be in contact with, or separable from, the fixed contact 22.

One terminal of the fixed contact 22 may be connected to a main power source, while the other terminal thereof may be connected to a load.

Here, one terminal of the fixed contact 22 may be spaced apart from the other terminal of the fixed contact 22 so as to be electrically separated therefrom.

The moving contact 24 may be disposed between one terminal of the fixed contact 22 and the other terminal of the fixed contact 22. One end of the moving contact 24 may be disposed to contact one terminal of the fixed contact 22, while the other end thereof may be disposed to contact the other terminal of the fixed contact 22.

Therefore, when both ends of the moving contact 24 contact both terminals of the fixed contact 22 simultaneously, the main power source and the load are electrically connected to each other to thereby supply power to the load. In addition, when both ends of the moving contact 24 are separated from both terminals of the fixed contact 22, the main power source and the load are separated from each other to thereby stop the supply of power to the load.

The moving contact 24 may be movable with respect to the fixed contact 22 in a vertical direction. To this end, the moving contact 24 may be disposed above the fixed contact 22, and the moving contact 24 may be coupled to the top of the moving core 80 to be moved upwardly and downwardly by the moving core 80.

Therefore, when the moving core 80 moves downwardly, the moving contact 24 of the moving core 80 contacts the fixed contact 22, and accordingly, the moving contact 24 and the fixed contact 22 may be electrically connected to each other.

Meanwhile, the moving core 80 and the fixed core 40 may be kept spaced apart from each other by a return spring 75, and accordingly, there is a gap therebetween. However, when the magnetic contactor 100 is initially operated, a distance between the moving core 80 and the fixed core 40 is relatively large. Because of such a wide gap and high magnetic resistance, it may be difficult for a magnetic flux to pass across the gap. For this reason, electromagnetic force is low and the operating time is extended at the time of initially closing the magnetic contactor.

To this end, in the magnetic contactor 100 according to the present exemplary embodiment, at least one protrusion 45 may be formed on the fixed core 40.

The protrusion 45 may protrude from the upper surface of the upper plate 41 of the fixed core 40. In addition, the protrusion 45 may be disposed outside the first core plate 81 when the first core plate 81 of the moving core 80 contacts the upper plate 41 of the fixed core 40.

Therefore, a vertical distance (a gap) h (see FIG. 1) between the first core plate 81 and the upper plate 41 may be maintained, while a minimum distance k (see FIG. 1) between the first core plate 81 and the upper plate 41 may be shorter than the vertical distance h by the protrusion 45.

In this case, a magnetic path may be formed from the moving core 80 to the fixed core 40 via the protrusion 45. Thus, while a movable range of the moving core 80 is maintained, the gap may be minimized. Therefore, at the time of initial operation, electromagnetic force required for driving the moving core 80 may be increased.

Meanwhile, the protrusion 45 according to the present exemplary embodiment may not only be formed on the upper plate 41 of the fixed core 40, but may also be formed on the lower plate 42 of the fixed core 40 in the same manner. Accordingly, while a vertical distance (a gap) between the second core plate 82 and the lower plate 42 is maintained, a minimum distance between the second core plate 82 and the lower plate 42 may be shorter than the vertical distance by the protrusion 45.

In addition, one end of the moving core 80 may be provided with the return spring 75 to apply elastic force to the moving core 80. The moving core 80 may be returned to the initial position thereof by the return spring 75. Here, the initial position refers to a state in which the fixed contact 22 and the moving contact 24 are separated from each other.

When power is applied to the coil 35, the moving core may move to allow the moving contact 24 to contact the fixed contact 22. When the supply of power to the coil 35 is cut off, the moving core 80 may move to the initial position thereof by which the moving contact 24 is separated from the fixed contact 22 by the elastic force of the return spring 75.

The return spring 75 may be extended in a direction in which the moving core 80 moves. For example, the return spring 75 may be a compressive coil spring.

In addition, the return spring 75 may be disposed on the bottom of the moving core 80. The top of the return spring 75 may contact the bottom of the moving core 80, while the bottom thereof may penetrate through the fixed core 40 to support the bottom of the case 10.

Hereinafter, the operations of the magnetic contactor 100 according to the present exemplary embodiment will be detailed.

As illustrated in FIG. 1, when power is not applied to the coil 35, the moving core 80 may be in a cut-off position due to being moved upwardly by the elastic force of the return spring 75. Accordingly, the moving contact 24 may be spaced apart from or separated from the fixed contact 22 so as to be positioned to cut off the main power source.

Lines of magnetic force generated by the permanent magnet 50 may be formed around the fixed core 40 and the permanent magnet plate 70 (see the directions of arrows illustrated in FIG. 1). Accordingly, magnetic attraction may occur between the second core plate 82 and the permanent magnet plate 70.

Subsequently, when power is applied to the coil 35, the lines of magnetic force may be formed from the bottom of the moving core 80 to the top thereof as illustrated in FIG. 2, and accordingly, the first core plate 81 and the second core plate 82 may be used as a magnetic path through which a magnetic flux flows.

Therefore, as illustrated in FIG. 3, the first core plate 81 and the second core plate 82 may move in a downward direction in which magnetic resistance is reduced.

At this time, the gap (see k in FIG. 1) between the first core plate 81 and the fixed core 40 and the gap between the second core plate 82 and the fixed core 40 may be narrow due to the protrusion 45 formed on the fixed core 40, whereby the magnetic flux may easily flow, and high electromagnetic force may be obtained. Therefore, the operating time may be minimized.

Therefore, the moving core 80 including the first core plate 81 and the second core plate 82 may move downwardly in the axial direction, and the moving contact 24 coupled to the moving core 80 also move together so that the moving contact 24 comes in contact with the fixed contact 22. Therefore, the power from the main power source may be supplied to the load, thereby driving the load.

Meanwhile, when the supply of power to the coil 35 is stopped, the lines of magnetic force from the permanent magnet 50 may be formed in the directions of the arrows illustrated in FIG. 1. Therefore, the moving core 80 may be moved to the initial position thereof by the return spring 75, and accordingly, the magnetic contactor 100 may return to the state illustrated in FIG. 1.

The configuration of the magnetic contactor is not limited to the above-described exemplary embodiment, and various modifications thereto may be made.

Figure 4:
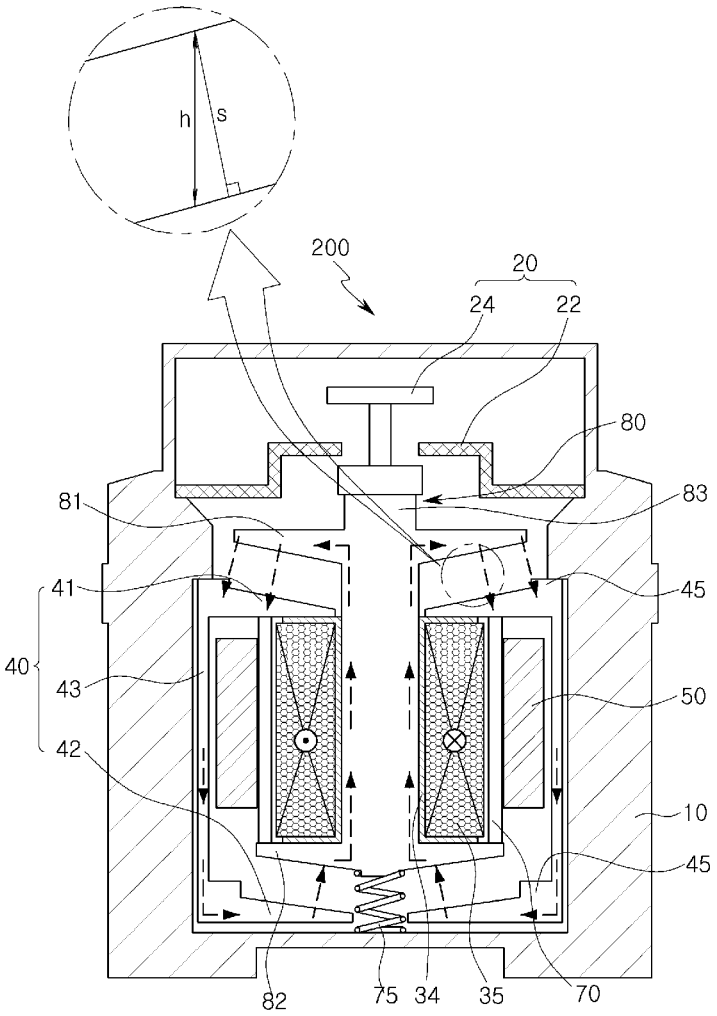
FIGS. 4 and 5 are schematic cross-sectional views of a magnetic contactor according to another exemplary embodiment of the present inventive concept.
Figure 5:
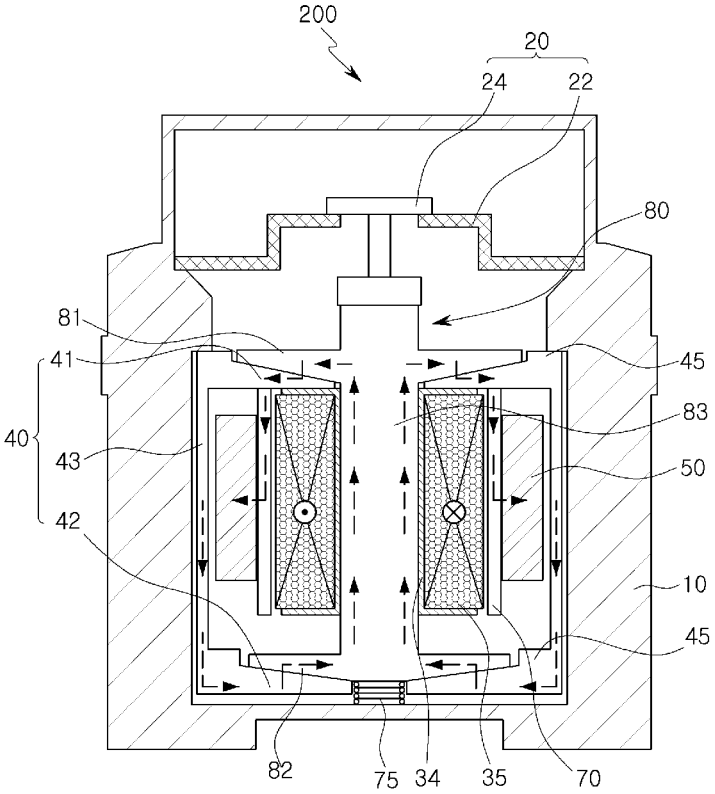

FIGS. 4 and 5 are schematic cross-sectional views of a magnetic contactor according to another exemplary embodiment of the present inventive concept. FIG. 4 illustrates a state of the magnetic contactor at the time of application of power to the coil 35. FIG. 5 illustrates a state of the magnetic contactor in which the moving core 80 is moved after power is applied to the coil 35.

The present exemplary embodiment is substantially similar to the previous exemplary embodiment, with the exception of the shapes of the moving core 80 and the fixed core 40. Therefore, details of similar features will be omitted, and different features will be detailed.

Referring to FIG. 4, in a magnetic contactor 200 according to the present exemplary embodiment, surfaces of the first and second core plates 81 and 82 of the moving core 80 and surfaces of the upper and lower plates 41 and 42 of the fixed core 40 facing one another may be inclined.

That is, the upper surfaces of the upper and lower plates 41 and 42 of the fixed core 40 may be inclined to be gradually lowered toward the main core 83, and the lower surfaces of the first and second core plates 81 and 82 of the moving core 80 may be inclined to be parallel to the inclined upper surfaces of the upper and lower plates 41 and 42.

In this case, as illustrated in FIG. 4, a movement distance h between the first and second core plates 81 and 82 and the upper and lower plates 41 and 42 is maintained to be the same as that in the previous exemplary embodiment. However, a minimum distance for the formation of a magnetic path is a perpendicular distance s between the inclined surfaces, and is shorter than the movement distance h.

In the magnetic contactor 200 according to the present exemplary embodiment, the same movement distance h may be maintained, while the distance for the formation of the magnetic path in the gap may be reduced. Therefore, strong electromagnetic force may be secured.

When power is applied to the coil 35 of the magnetic contactor 200 according to the present exemplary embodiment, the moving core 80 may move as illustrated in FIG. 5 so that the moving contact 24 contacts the fixed contact 22.

As set forth above, in a magnetic contactor according to exemplary embodiments of the present inventive concept, a magnetic path may be formed from a moving core to a fixed core via a protrusion. Thus, while a movable range of the moving core is maintained, a gap between the moving core and the fixed core may be minimized. Therefore, when the magnetic contactor is initially operated, electromagnetic force required for driving the moving core 80 may be increased to thereby ensure rapid action.

While exemplary embodiments have been shown and described above, it will be apparent to those skilled in the art that modifications and variations could be made without departing from the scope of the invention as defined by the appended claims.

What is claimed is:

1. A magnetic contactor comprising:

a moving core including a main core disposed to be movable in a length direction thereof and first and second core plates disposed at both ends of the main core, respectively;

a coil provided on the circumference of the main core;

a fixed core disposed around the coil to form a magnetic path; and a permanent magnet disposed between the coil and the fixed core, wherein the first core plate is disposed outside the fixed core, the second core plate is disposed inside the fixed core, and the fixed core is provided with at least one protrusion to reduce a gap between the fixed core and the first or second core plate.

2. The magnetic contactor of claim 1, wherein the protrusion is disposed outside the first core plate when the first core plate moves close to the fixed core.

3. The magnetic contactor of claim 2, wherein the protrusion is disposed outside the second core plate when the second core plate moves close to a bottom surface of the fixed core in the interior of the fixed core.

4. The magnetic contactor of claim 1, wherein the fixed core includes an upper plate and a lower plate disposed to face lower surfaces of the first core plate and the second core plate, respectively.

5. The magnetic contactor of claim 4, wherein the upper plate and the lower plate have inclined upper surfaces.

6. The magnetic contactor of claim 5, wherein the inclined surfaces are gradually lowered toward the main core.

7. The magnetic contactor of claim 6, wherein the lower surfaces of the first core plate and the second core plate are inclined to be parallel to the inclined surfaces of the upper plate and the lower plate.

* * * * *